United States Patent [19]

Mowli et al.

[11] 4,138,932

[45] Feb. 13, 1979

[54] PROCESS FOR PRODUCING RECLOSABLE BAGS

[76] Inventors: John C. Mowli, 2032 W. Jarvis, Chicago, Ill. 60645; Harry Bala, 2259 N. Kedzie, Chicago, Ill. 60647

[21] Appl. No.: 788,816

[22] Filed: Apr. 19, 1977

[51] Int. Cl.[2] ..... B31B 19/00; B31B 1/90

[52] U.S. Cl. ..... 93/35 DS; 93/33 H

[58] Field of Search ..... 229/65; 93/35 R, 35 DS, 93/33 H, DIG. 1, 1 TS, 8 R

[56] References Cited

U.S. PATENT DOCUMENTS

| | | | |
|---|---|---|---|
| 3,079,844 | 3/1963 | Kugler | 93/35 DS |
| 3,688,973 | 9/1972 | Lillkvist | 229/65 X |
| 3,859,895 | 1/1975 | White | 93/35 DS |
| 4,051,994 | 10/1977 | Donk et al. | 229/65 |

FOREIGN PATENT DOCUMENTS

| | | | |
|---|---|---|---|
| 2291025 | 11/1976 | France | 93/35 DS |

*Primary Examiner*—James F. Coan
*Attorney, Agent, or Firm*—George H. Gerstman

[57] ABSTRACT

A method is provided for producing a reclosable plastic bag formed of heat sealable material. A web of the material is fed to a main folding station. A continuous length of a closure strip, capable of being bent manually and retaining its bent shape, is provided. The closure strip overlies the web adjacent one longitudinal side thereof but inwardly a sufficient distance to permit a portion of the web to be folded over the closure strip. The overfolded web portion is heat sealed to the web to form a pocket receiving the closure strip. Thereafter, the web is folded longitudinally at the folding station and the folded product is conveyed to a heat sealing and cutting station.

The resulting product comprises a reclosable plastic bag having a front wall, a back wall, a closed bottom and heat sealed side edges. The closure strip extends transverse the width of the bag substantially from one side of the bag to the other side. The back wall of the bag is folded over the closure strip and sealed to itself whereby the closure strip is intermediate two plies formed from the back wall.

3 Claims, 5 Drawing Figures

FIG. 1
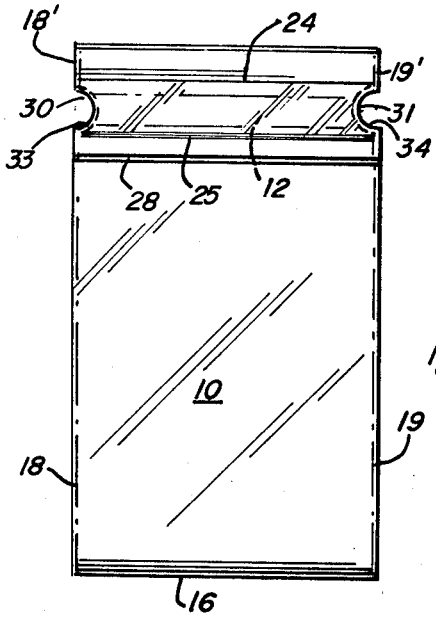
FIG. 2
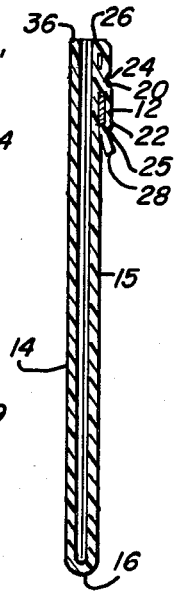
FIG. 3
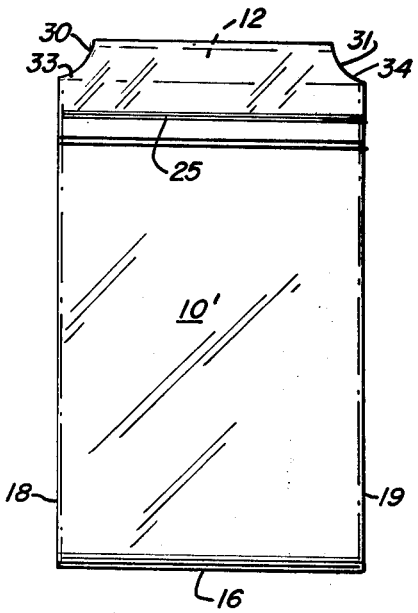
FIG. 4
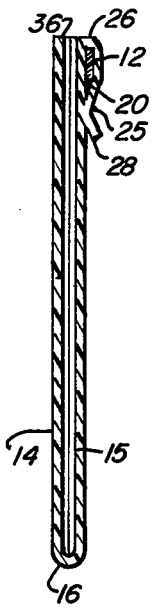
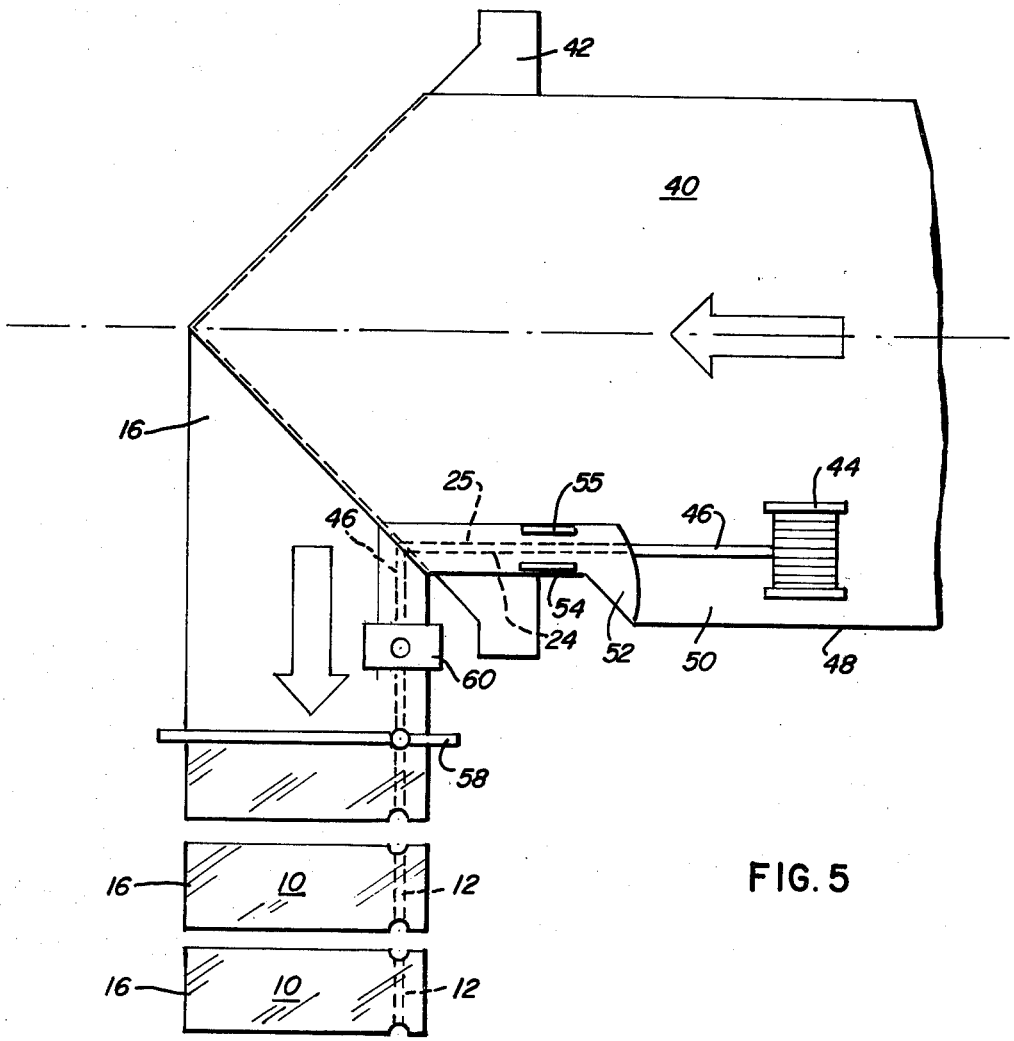
FIG. 5

PROCESS FOR PRODUCING RECLOSABLE BAGS

BACKGROUND OF THE INVENTION

This invention rleates to a novel method of producing a reclosable bag and the product reclosable bag which is inexpensive to manufacture and easy to use.

An increasing number of articles are packaged in plastic bags. In addition, rolls of plastic bags are presently sold for consumer use in packaging household items or the like. It is often desirable to have the ability to remove at least part of the bag's contents and reclose the bag thereafter. However, various disadvantages have been found with prior art reclosable bags.

For example, one type of reclosable bag is disclosed in Ruda U.S. Pat. No. 3,759,438. In the Ruda construction, a stiffener is located inside the mouth of the bag, which provides a construction that is relatively difficult to manufacture. In the Ruda construction, in order to heat seal the stiffener special equipment is required having an insulative device between the plies of the bag, so that the front and back plies of the bag will not become heat sealed to each other. Thus in producing Ruda's reclosable bag, it is advantageous to heat seal the stiffener prior to heat sealing the sides of the bag. At that time, the front and back plies of the bag are not adjacent each other and the stiffener may be heat sealed without heat sealing the front and back plies of the bag to each other. In any event, in manufacturing the Ruda reclosable bag at least two separate heat sealing steps are required using two different machine operations. Additionally, by using a stiffener which has a length substantially less than the width of the bag, a continuous flow operation is difficult. In such cases, an intermittent break off is required, thereby preventing a continuous operation.

The prior art patent to White, U.S. Pat. No. 3,889,871, discloses another type of reclosable bag in which a separate tape is required to connect the stiffener to the bag. The requirement of a separate fastening means is deleterious to optimum manufacture.

Another type of alleged reclosable bag construction is disclosed in Hoeppner, et al. U.S. Pat. No. 2,620,842, in which a flap overlies the front wall and mouth of the bag, to provide a handle and closure means. However, the security of the Hoeppner, et al. bag is questionable because there is no tie or stiffener to provide a repeatable secure closure.

The prior art patents to Rivman, et al. U.S. Pat. No. 3,321,126 and Chesney U.S. Pat. No. 587,928 show other prior art reclosable containers. In the Rivman, et al. patent, an external strip is required to be fastened over a wire stiffener. This has the disadvantage mentioned above in connection with White U.S. Pat. No. 3,889,871. Chesney discloses a paper container in which a stiffener is fastened below the mouth of the bag, so that the mouth of the bag becomes rolled about with the stiffener being bent to close the roll. In the Chesney construction, an external fastening strip is needed to fasten the stiffener to the bag.

It is an object of the present invention to provide a plastic bag that overcomes many of the disadvantages of prior art plastic bags, and a novel process which produces such plastic bags in an extremely efficient and relatively inexpensive manner.

Another object of the present invention is to provide a novel process for producing a reclosable plastic bag of a type which does not require external fastening means.

A further object of the present invention is to provide a plastic bag construction in which the bag is heat sealed to contain a stiffener, with the heat sealing being accomplished in an efficient manner.

Another object of the present invention is to provide a process for producing a reclosable plastic bag using a continuous closure strip, thereby obviating the necessity for an intermittent break off.

Other objects and advantages of the present invention will become apparent as the description proceeds.

SUMMARY OF THE INVENTION

In accordance with the present invention, a method is provided for producing a reclosable bag. The method includes the steps of feeding to a main folding station a web of heat sealable material and providing a continuous length of a closure strip which is capable of being bent manually and retaining its bent shape. The closure strip is laid over the web adjacent one longitudinal side of the web but inwardly a sufficient distance to permit a portion of the web adjacent the longitudinal side to be folded over the closure strip. The adjacent web portion is then folded over the closure strip.

Thereafter, the overfolded web portion is heat sealed to the web to form a pocket in which the closure strip is received. Thereafter, the web is folded longitudinally at the main folding station so that the side of the web opposite the one side is brought adjacent the heat sealed portion. The folded web is conveyed to a cutting station and the web is heat sealed and cut transverse the folded web to form a reclosable bag.

In the illustrative embodiment, openings are punched through the overfolded web portion and closure strip prior to the transverse heat sealing step, at positions for alignment with the transverse heat seal. In this manner, the transverse heat seal will not contact the closure strip.

The product of the process according to the present invention comprises a reclosable bag formed of heat sealable film-type material. The bag includes a front wall, a back wall, a closed bottom and heat sealed side edges. A closure strip extends transverse the width of the bag substantially from one side of the bag to the other side. The back wall is folded over the closure strip and sealed to itself, with the closure strip being intermediate at least two plies formed from the back wall.

A more detailed explanation of the invention is provided in the following description and claims, and is illustrated in the accompanying drawings.

BRIEF DESCRIPTION OF THE DRAWINGS

FIG. 1 is a front view of a reclosable bag constructed in accordance with the principles of the present invention;

FIG. 2 is a cross-sectional view thereof, taken along the plane of the line 2—2 of FIG. 1;

FIG. 3 is a front view of a reclosable bag constructed in accordance with a modified form of the present invention;

FIG. 4 is a cross-sectional view thereof, taken along the plane of the line 4—4 of FIG. 3; and FIG. 5 is a flow diagram of a process for producing reclosable bags in accordance with the principles of the present invention.

DETAILED DESCRIPTION OF THE ILLUSTRATIVE EMBODIMENT

Referring to the embodiment of FIGS. 1 and 2, plastic bag 10 is shown therein formed of heat sealable film-type material, such as polyethylene. It is understood, however, that there is no limitation with respect to the type of heat sealable film-type plastic material which could be used for the body of the bag.

The bag 10 includes a closure strip 12 used in securing the closure of the bag. Closure strip 12 may be formed of any material capable of being bent manually and retaining the bent shape. Thus the closure strip 12 may be formed of metal, plastic, paper-coated wire, or any other suitable material.

Reclosable bag 10 comprises a front wall 14, a back wall 15, a closed bottom 16 and heat sealed side edges 18 and 19. As shown most clearly in FIG. 2, the upper portion of back wall 15 is folded about itself to form a pocket 20 enclosing closure strip 12. Thus an overfolded portion 22 of the back wall 15 is heat sealed along lines 24, 25 to form pocket 20.

In the embodiment of FIGS. 1 and 2, heat seal 24 is spaced from the top 26 of back wall 15 so that the closure strip 12 will be received in pocket 20 which is spaced from top 26 of the back wall. Heat seal 24 is provided between closure strip 12 and the distal end 28 of overfolded portion 22.

A pair of openings 30, 31 are provided at opposite ends of closure strip 12, using the process of the present invention in manufacturing the reclosable bags of FIGS. 1–2. If desired, the edges 33, 34 defining openings 30, 31 (respectively) may be heat sealed.

As shown most clearly in FIG. 2, the top 36 of front wall 14, together with the top 26 of back wall 15, forms the mouth of the reclosable bag. While top 36 is shown aligned with top 26, it is to be understood that the top 26 may be aligned with a lower plane. For example, top 36 may be located below the plane of closure strip 12, if desired.

In using the reclosable bag of FIGS. 1–2, if an article is inside the bag and reclosure of the bag is desired, the top portion of the bag is merely folded over two or three times and the closure strip 12 is bent circularly or in any advantageous manner to prevent the folds from unfolding. The simplicity of the closure operation is readily apparent.

Now referring to the embodiment of FIGS. 3 and 4, identical numerals have been used in these Figures to correspond to identical portions of the reclosable bag of FIGS. 1 and 2. However, the reclosable bag 10' of FIGS. 3–4 includes a closure strip 12 located adjacent top 26 of back wall 15. To this end, the pocket 20 is formed by a single heat seal 25, transverse the width of bag 10' and intermediate closure strip 12 and distal end 28 of back wall 15.

The additional side edge portion 18', 19' of the reclosable bag of FIGS. 1 and 2 maintains the width of the bag so that the mouth opening will have essentially the same width as the distance between side edges 18, 19. On the other hand, in the bag of FIGS. 3 and 4, it can be seen that the top of the mouth opening has a smaller dimension than the distance between edges 18, 19 and that if heat seals 33, 34 are not provided, the bag would open in a V-shaped configuration.

The process for manufacturing the reclosable bag of FIGS. 1–2 is shown in diagrammatic form in FIG. 5. As shown therein, a web 40 of heat sealable film-type material is fed to a standard folding station 42. A spool 44 containing a continuous length of closure strip 46 is provided, with the length of closure strip 46 extending parallel to one end 48 of web 40, adjacent end 48, but spaced a sufficient distance from end 48 to allow portion 50 of web 40 to be folded over the closure strip 46. In this manner, as portion 50 reaches folding station 52, portion 50 is folded over closure strip 46 and a pair of heat seal rollers 54, 55 form heat seals 24, 25, respectively, on opposite sides of closure strip 46.

Thereafter, web 40 with portion 50 folded over the closure strip and heat sealed to the web, is folded at folding station 42 to provide a folded bottom 16, and the folded material is fed to a heat seal and cutoff station 58.

Upstream of heat seal and cutoff station 58 a punching station 60 is provided to punch an opening greater in diameter than the width of closure strip 46, so that the heat seal and cutoff blade at station 58 can operate without passing through the closure strip. This avoids possible damage to the heat seal and cutoff blade which might occur if the closure strip were present at the location where the heat seal and cutoff blade heat seal and cut off the folded web.

As shown in FIG. 5, the heat seal and cutoff blade is synchronized so that a seal and cut will be made at each punched opening, thereby forming a series of reclosable bags 10 as the cutoffs are made. This highly efficient and relatively inexpensive process provides a novel reclosable bag using continuous materials and production techniques having minimal steps and apparatus requirements.

If desired, slots or openings can be defined by the closure strip itself so that the overfolded portion of the back wall can be heat sealed to the back wall through the closure strip itself, thereby firmly securing the closure strip to the back wall. Thus the closure strip may be tightly enclosed by the heat seal back wall folded over itself, or the closure strip 12 may be loose or slidable within the pocket 20 formed by the heat seal. Further, the ends of the pocket 20 may be left not heat sealed, to permit the closure member to slide out or be inserted into the pocket.

Although illustrative embodiments of the invention have been shown and described, it is to be understood that various modifications and substitutions may be made by those skilled in the art without departing from the novel spirit and scope of the present invention.

We claim:

1. A method of producing a reclosable bag which comprises the steps of:

feeding to a main folding station a web of heat sealable material;

providing on only one side of the web a continuous length of a metallic closure strip, which is capable of being bent manually and retaining its bent shape;

overlying said closure strip over said web adjacent only one longitudinal side of said web and inwardly a sufficient distance (a) to permit a portion of the web adjacent to said longitudinal side to be folded over the metallic closure strip, and (b) to space the metallic closure strip from the fold line formed thereby, so that a subsequent transverse heat sealing step provides heat seals between the closure strip and said fold line, on both sides of the resulting bag;

folding said adjacent web portion over the closure strip;

heat sealing said overfolded web portion to said web to form a pocket in which said closure strip is received;

folding the web longitudinally at said main folding station so that the side of said web opposite the one side is brought adjacent the heat sealed portion;

punching openings through said overfolded web portion and closure strip;

conveying said folded web to a cutting station; and thereafter heat sealing and cutting said web transversely of said folded web through the punched openings to form a reclosable bag, with heat seals being provided thereby on both sides of the bag including the side portions between the closure strip and said fold line.

2. A method as described in claim 1, wherein said transverse seal and cutting steps are performed simultaneously.

3. A method as described in claim 1, including the step of heat sealing the edges of said web defining the punched openings.

* * * * *